US010511082B2

(12) United States Patent
Perez et al.

(10) Patent No.: US 10,511,082 B2
(45) Date of Patent: Dec. 17, 2019

(54) ANTENNA

(71) Applicant: Intel Corporation, Santa Clara, CA (US)

(72) Inventors: Jose Rodrigo Camacho Perez, Guadalajara Jalisco (MX); Seong-Youp J. Suh, Portland, OR (US); Tae-Young Yang, Hillsboro, OR (US)

(73) Assignee: Intel Corporation, Santa Clara, CA (US)

( * ) Notice: Subject to any disclaimer, the term of this patent is extended or adjusted under 35 U.S.C. 154(b) by 592 days.

(21) Appl. No.: 15/198,782

(22) Filed: Jun. 30, 2016

(65) Prior Publication Data

US 2018/0006360 A1 Jan. 4, 2018

(51) Int. Cl.

| | |
|---|---|
| ***H01Q 1/24*** | (2006.01) |
| ***H01Q 1/22*** | (2006.01) |
| ***H01Q 1/48*** | (2006.01) |
| ***H01Q 1/50*** | (2006.01) |
| ***H01Q 13/02*** | (2006.01) |
| ***H01Q 21/28*** | (2006.01) |
| ***H01Q 5/40*** | (2015.01) |

(52) U.S. Cl.

CPC ..... *H01Q 1/243* (2013.01); *H01Q 1/2275* (2013.01); *H01Q 1/48* (2013.01); *H01Q 1/50* (2013.01); *H01Q 5/40* (2015.01); *H01Q 13/02* (2013.01); *H01Q 21/28* (2013.01)

(58) Field of Classification Search

CPC .. H01Q 1/24; H01Q 5/40; H01Q 1/22; H01Q 1/48; H01Q 1/50; H01Q 13/02; H01Q 21/28

USPC ..... 343/702

See application file for complete search history.

(56) References Cited

U.S. PATENT DOCUMENTS

| | | | | |
|---|---|---|---|---|
| 2002/0027528 | A1* | 3/2002 | Okabe | H01Q 1/243 343/702 |
| 2005/0017909 | A1 | 1/2005 | Carpenter et al. | |
| 2012/0013518 | A1 | 1/2012 | Konishi | |
| 2015/0188239 | A1* | 7/2015 | Tong | H01Q 1/243 343/720 |
| 2016/0164186 | A1 | 6/2016 | Ganchrow et al. | |

OTHER PUBLICATIONS

European Search Report dated Nov. 17, 2017 for European Application No. 17174854.4.

(Continued)

*Primary Examiner* — Andrea Lindgren Baltzell

(74) *Attorney, Agent, or Firm* — Schiff Hardin LLP

(57) ABSTRACT

An antenna including a substrate; top and bottom grounded conductive layers formed on respective larger faces of the substrate; an antenna feed coupled to at least one of the top and bottom grounded conductive layers, and configured to feed radio signals to the antenna; and at least one conductive wall formed to the top and bottom grounded conductive layers, and configured to form a short-circuit between the top and bottom grounded conductive layers, wherein the substrate and the at least one conductive wall forms a plurality of antenna cavities configured to operate at specific, respective frequencies, and each of the plurality of antenna cavities comprises at least two sides not covered by a conductive layer.

25 Claims, 8 Drawing Sheets

(56) References Cited

OTHER PUBLICATIONS

Jin Cheng et al: "Self-Shielded Circularly Polarized Antenna-in-Package Based on Quarter Mode Substrate Integrated Waveguide Subarray", IEEE Transactions on Components, Packaging and Manufacturing Technology, IEEE, USA, vol. 4, No. 3, Mar. 1, 2014.
Siew Bee Yeap, et al; "140-GHz 2*2 SIW Horn Array on LTCC", Antennas and Propagation (APCAP), 2012 IEEE Asia-Pacific Conference on, IEEE, Aug. 27, 2012 (Aug. 27, 2012) pp. 279-280.

* cited by examiner

ANTENNA

TECHNICAL FIELD

The present disclosure generally relates to an antenna, and more specifically to an antenna having multiple cavities, an irregular contour and/or an irregular thickness.

BACKGROUND

A problem in antenna design for small-form factor devices, such as smartphones and smart-watches, is that significant antenna re-design effort is often required to deliver Stock Keeping Units (SKUs) to a world-wide market. Typically, this redesign is required to reduce the performance impact by objects that are in close proximity with the antenna. These objects include, for example, connectors, cables, display, speakers, microphones, battery, vibration motor, etc. In addition, antenna engineers need to ensure consistent antenna performance for various applications. If an industrial design with a metallic uni-body is preferred to improve look-and-feel and user experience, it becomes challenging to meet all of the antenna performance specifications, Federal Communications Commission (FCC) compliances, and industrial design preferences. Hence, a consequence is an increased per-unit antenna cost because of the higher material and manufacturing cost resulting from the lower volume of each SKU. Additionally, antenna re-design implies cost in terms of man-hours of specialized engineers, computing resources, and time to market.

DESCRIPTION OF THE ASPECTS

The present disclosure is directed to an antenna having multiple cavities, an irregular contour and/or an irregular thickness that results in multi-band operation, improved bandwidth, and enhanced efficiency.

Figure 1A:
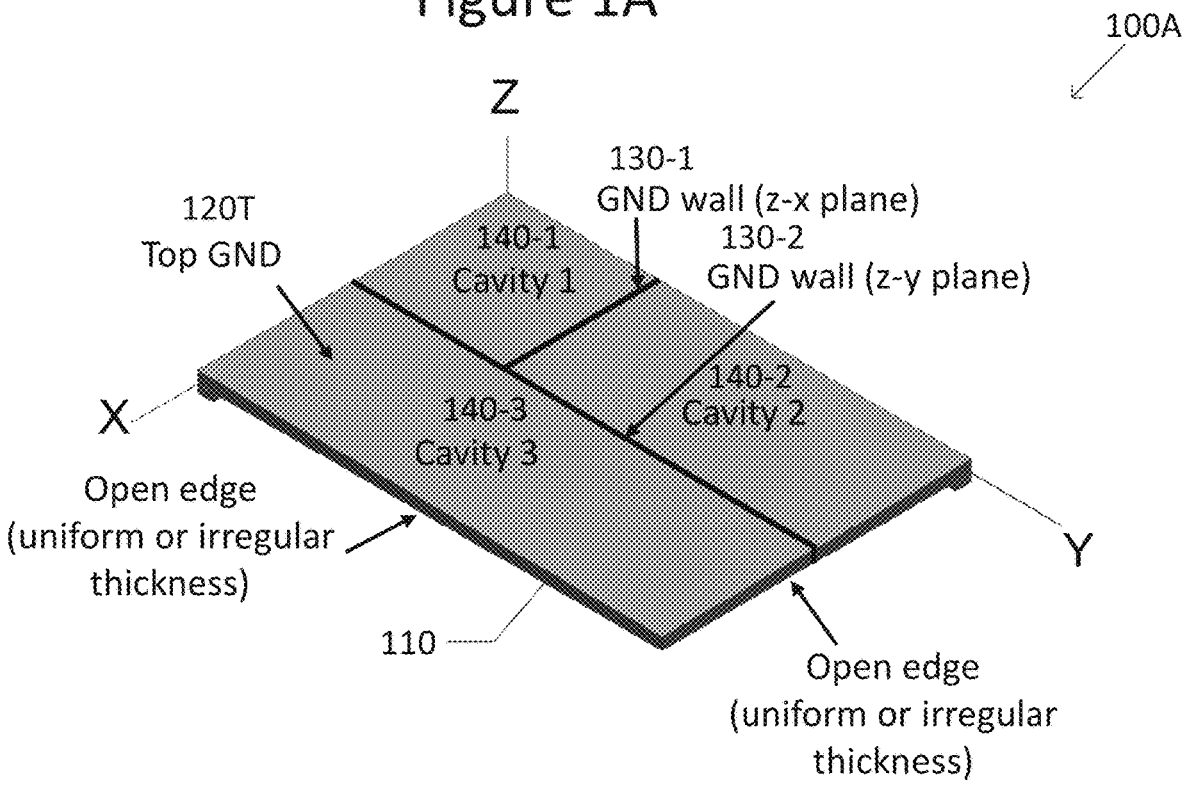
FIG. 1A illustrates a top view perspective diagram of a multi-cavity antenna in accordance with an aspect of the disclosure.
Figure 1B:
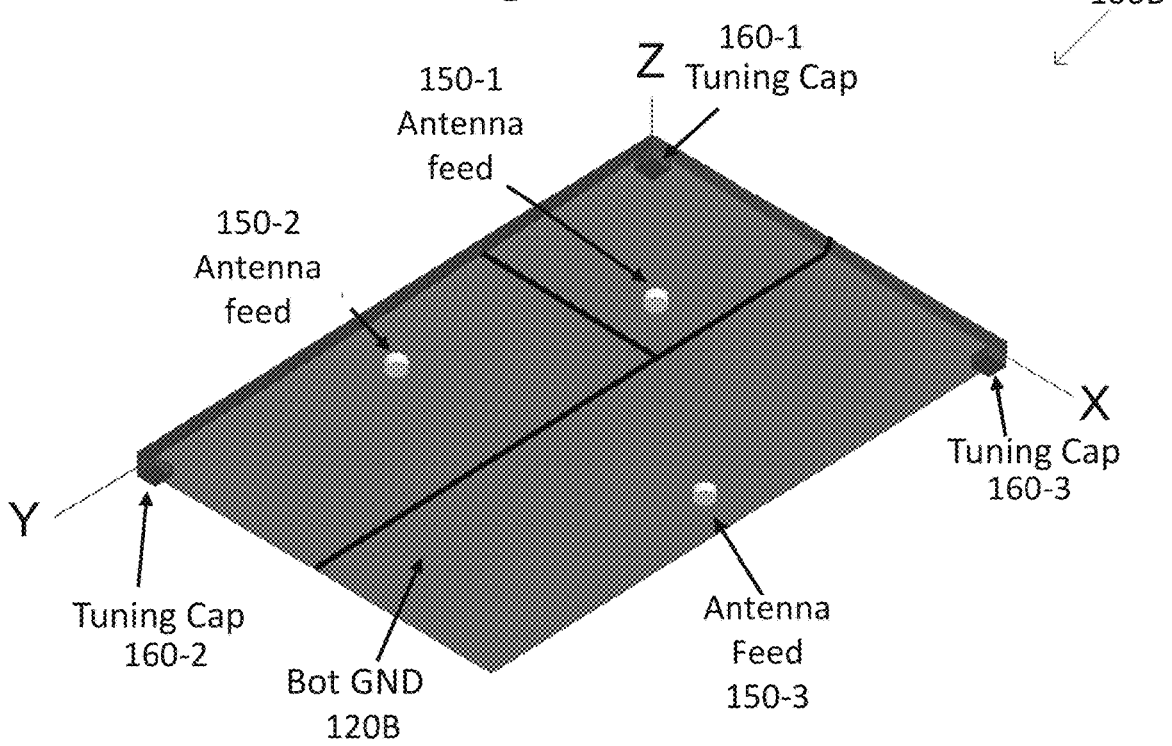
FIG. 1B illustrates a bottom view perspective diagram of the multi-cavity antenna of FIG. 1A.

FIG. 1A illustrates a top view perspective diagram of a multi-cavity antenna 100A in accordance with an aspect of the disclosure. FIG. 1B illustrates a bottom view perspective diagram of the multi-cavity antenna of FIG. 1A.

The multi-cavity antenna 100A comprises a dielectric substrate 110, top and bottom grounded conductive layers 120T, 120B, conductive walls 130-1, 130-2, and antenna feeds 150-1, 150-2, 150-3.

The substrate 110 may be formed of any dielectric material, such as a low-loss dielectric, air, magnetic material, or any combination of these materials, which provides irregular permittivity. Air may be feasible if the conductive walls 130-1, 130-2 are thick enough to provide stability. Also, the substrate 110 may have an irregular permittivity and/or permeability.

The top and bottom grounded conductive layers 120T, 120B are formed on respective larger faces of the dielectric substrate 110. The top and bottom grounded conductive layers 120T, 120B may comprise copper or any other suitable conductive material. Because the top and bottom conductive layers 120T, 120B are grounded, other elements can be located very close thereto and have minimal effect on resonance.

The conductive walls 130-1, 130-2 are formed orthogonal to the top and bottom grounded conductive layers 120T, 120B. The conductive walls 130-1, 130-2 are configured to form a short-circuit between the top and bottom grounded conductive layers 120T, 120B. The conductive walls 130-1, 130-2 may be solid conductive walls. Alternatively, these walls may be formed using vias for Printed Circuit Board (PCB) embodiments. More specifically, vias may be drilled and filled with conductive material to create cylinders. The figures show solid conductive walls for ease of illustration. Via arrays emulating solid walls provide very similar performance.

Three antenna cavities 140-1, 140-2, 140-3 are formed by the dielectric substrate 110, the grounded top and bottom conductive layers 120T, 1206, and the conductive walls 130-1, 130-2. Each of the antenna cavities 140-1, 140-2, 140-3 comprises two sides not covered by a conductive layer, and is configured to operate at specific, respective frequencies as required for the application.

An antenna feed 150-1, 150-2, 150-3 is coupled to at least one of the top and bottom grounded conductive layers 120T, 120B for each of the respective antenna cavities 140-1, 140-2, 140-3. As is well known, an antenna feed is configured to feed radio signals to its respective antenna cavity.

The cavity antenna is based on a cavity resonator, which is an enclosed metal structure containing electromagnetic waves reflecting back and forth between the cavity walls. The shape and size of the cavity determine a resonant frequency and electromagnetic modes. For instance, in the case of a square cavity, the dominant transverse electric resonance mode can be excited for a cavity with sides given roughly by:

$$L_{FullMode} \approx \frac{\lambda_0 1}{2\sqrt{\varepsilon_r}} \quad \text{(Equation 1)}$$

where $\lambda_0$ is a free-space wavelength corresponding to a the desired resonance frequency and $\varepsilon_r$ is a dielectric constant of a substrate. In this case, the cavity can be called a "Full-Mode" cavity.

With an all-side-enclosed metal structure, the electromagnetic energy is stored inside the cavity resonator. However, if openings are made to the cavity, the energy can leak out and the cavity can be used as a cavity antenna. An example, as used in this disclosure, is a cavity having two open sides, as is known as a "Quarter-Mode" cavity. In this case, the sides can be made half of the full-mode sides.

Optionally, any of the antenna cavities 140-1, 140-2, 140-3 may be tunable. An example application that requires a tunable antenna cavity is Long Term Evolution (LTE) that requires a plurality of bands. A tuning component 160-1, 160-2, 160-3, such as a digital tuning capacitor (DTC) variable inductor or variable capacitor, may be coupled to at least one of the top and bottom grounded conductive layers 120T, 120B, and configured to tune the respective antenna cavity 140-1, 140-2, 140-3 to a specific frequency as required for the application.

FIGS. 1A and 1B show an antenna 100 having a plurality of cavities 140-1, 140-2, 140-3 integrated in a single dielectric substrate 110. This dielectric substrate 110 is illustrated with a constant thickness and regular contour, but alternatively may have an irregular thickness and/or an irregular contour, as discussed below with respect to FIGS. 2A and 2B. Also, this embodiment is not limited to three cavities, but may have any number of cavities as suitable for a particular application.

Figure 2A:
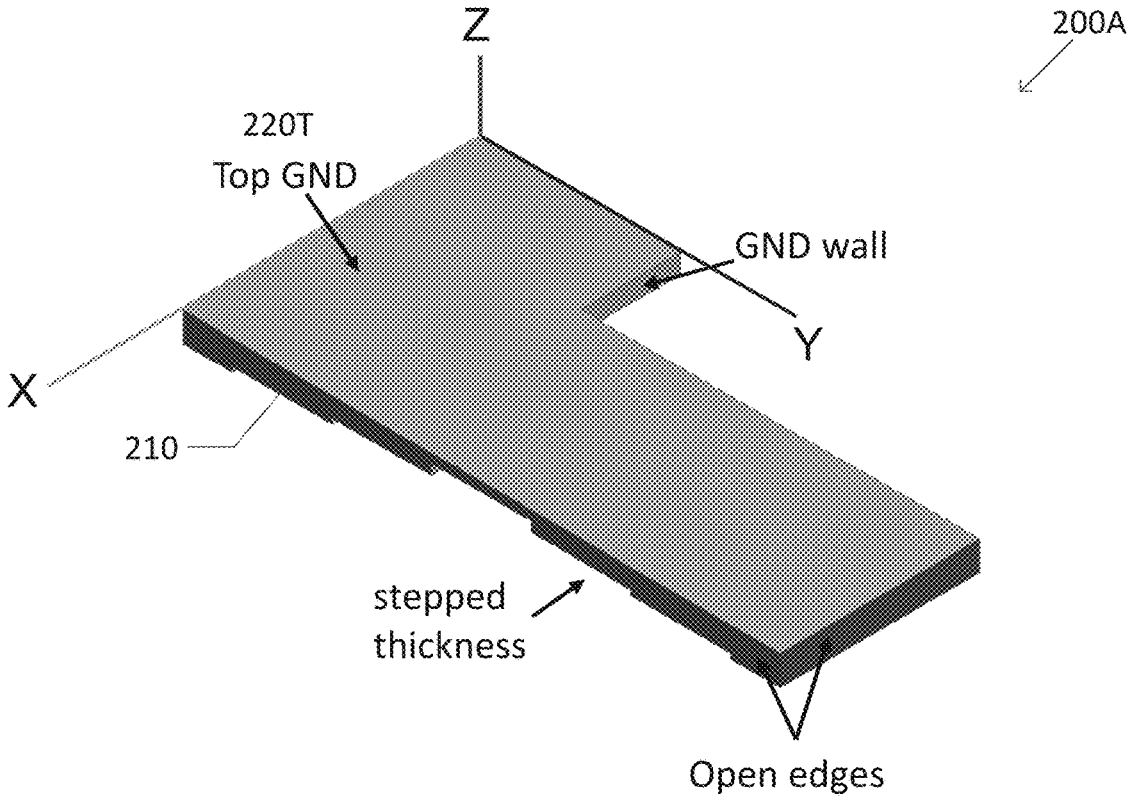
FIG. 2A illustrates a top view perspective diagram of a single-cavity antenna having an irregular contour and thickness in accordance with another aspect of the disclosure.
Figure 2B:
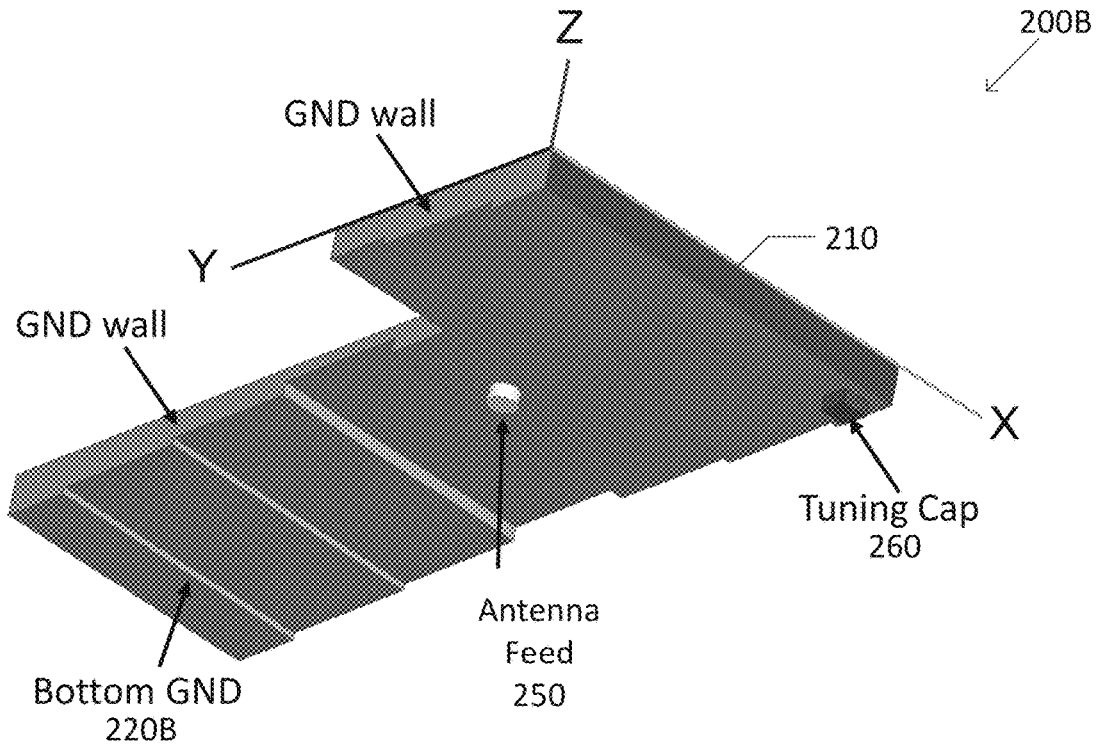
FIG. 2B illustrates a bottom view perspective diagram of the single-cavity antenna of FIG. 2A.

FIG. 2A illustrates a top view perspective diagram of a single-cavity antenna 200A having an irregular contour in accordance with another aspect of the disclosure. FIG. 2B illustrates a bottom view perspective diagram of the single-cavity antenna 200B of FIG. 2A.

The single-cavity antenna 200A comprises a dielectric substrate 210, top and bottom grounded conductive layers 220T, 220B, and an antenna feed 250.

The dielectric substrate 210 is shown having an irregular contour and an irregular thickness. Alternatively, the dielectric substrate 210 may have one of an irregular contour and an irregular thickness. To create such a dielectric substrate 210, a dielectric is molded or shaped. Alternatively, a thin dielectric layer may be formed, and additional dielectric layer(s) may be glued on top of the original dielectric layer.

The use of a dielectric substrate of irregular thickness provides a means for viable bandwidth (BW), efficiency, and volume tradeoffs. The thickness is expected to be as small as 1.5 mm for operation above 1.5 GHz. An irregular contour provides flexibility for integration in different configurations.

After the dielectric substrate 210 is formed, the top and bottom grounded conductive layers 220T, 220B are formed on respective larger faces of the dielectric substrate 210. Also, GND walls are formed on the sides of the dielectric substrate 210. At least two sides of the dielectric substrate 210 are not covered by a conductive layer so that the resonance cavity may operate as a resonance antenna.

The antenna feed 250 is coupled to the bottom conductive layer 220B, and is configured to feed radio signals to the antenna 200.

Optionally, the antenna cavity 240 may be tunable. A tuning component 260, such as a digital tuning capacitor (DTC), may be coupled to at least one of the top and bottom grounded conductive layers 220T, 220B, and configured to tune the antenna cavity 240 to a specific frequency as required for the application.

FIGS. 2A and 2B illustrate a dielectric substrate 210 with irregular contour and tapered thickness. The tapered thickness shown corresponds to a series of discrete thickness steps; however, this can be made with different profiles (a smooth curve for example). Alternatively, the dielectric substrate 210 may have a constant thickness and/or a regular contour, as discussed above with respect to FIGS. 1A and 1B.

Figure 3A:
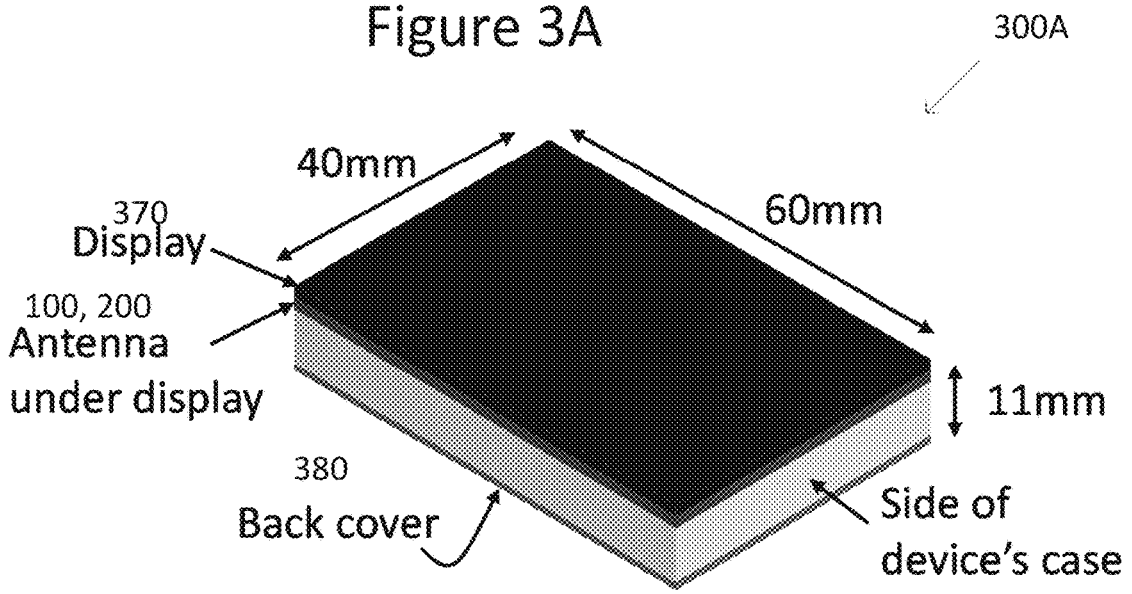
FIGS. 3A, 3B, and 3C illustrate top, bottom and side view perspective diagrams, respectively, of an antenna of any of FIG. 1A, 1B, 2A, or 2B located underneath a display of a wireless device.
Figure 3B:
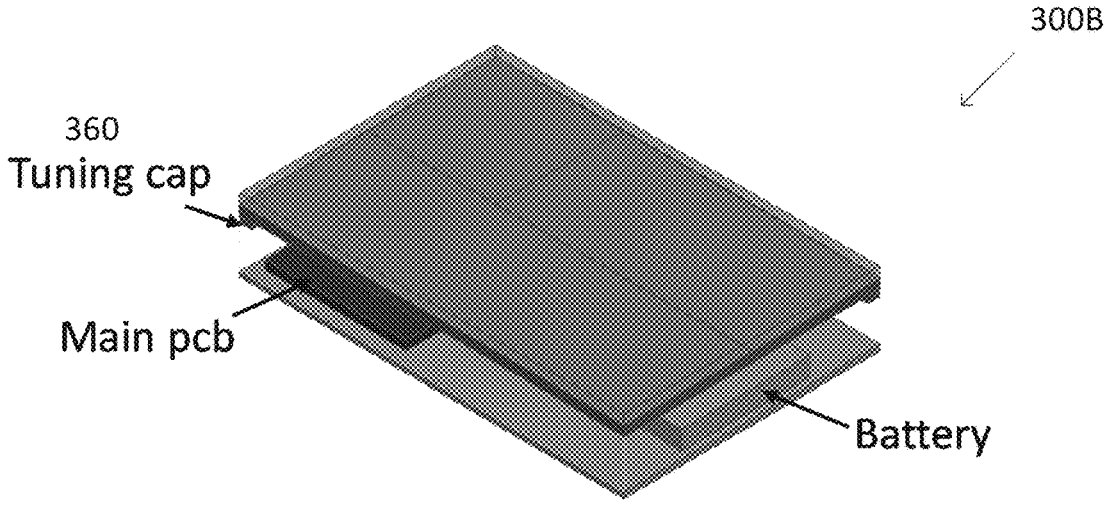
Figure 3C:
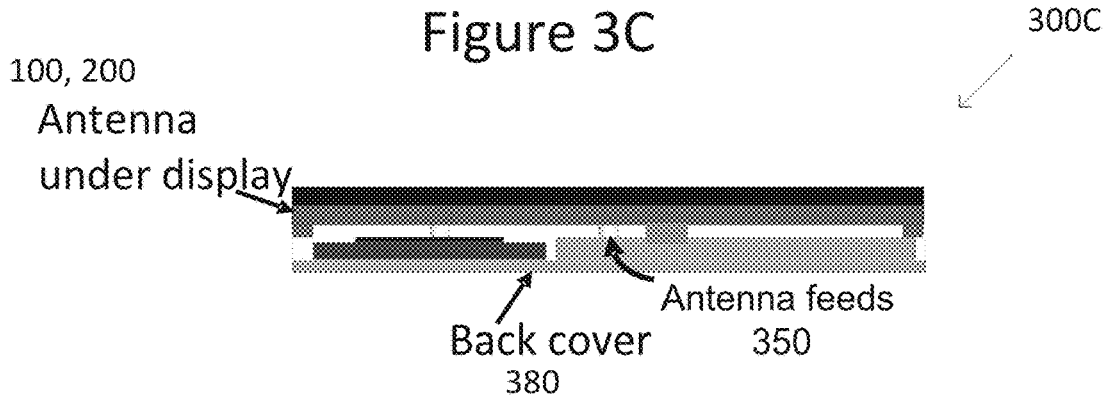

FIGS. 3A, 3B, and 3C illustrate top, bottom and side view perspective diagrams, respectively, of an antenna 100, 200 of any of FIG. 1A, 1B, 2A, or 2B located underneath a display of a wireless device 300.

The antenna 100, 200 of FIG. 1A, 1B, 2A, or 2B may be located underneath a display or top conducting cover 370 of a wireless device 300. Since the antenna 100, 200 of this disclosure have conducting layers that are grounded, other elements can be located very close to the antenna 100, 200 and have minimal effect on resonance. Thus, the antenna 100, 200 may be coupled to the display 370 of wireless device 300 as illustrated in FIGS. 3A-C. Similar features that are described above or that are well known and shown in FIGS. 3A-C are not described here for the sake of brevity.

Figure 4A:
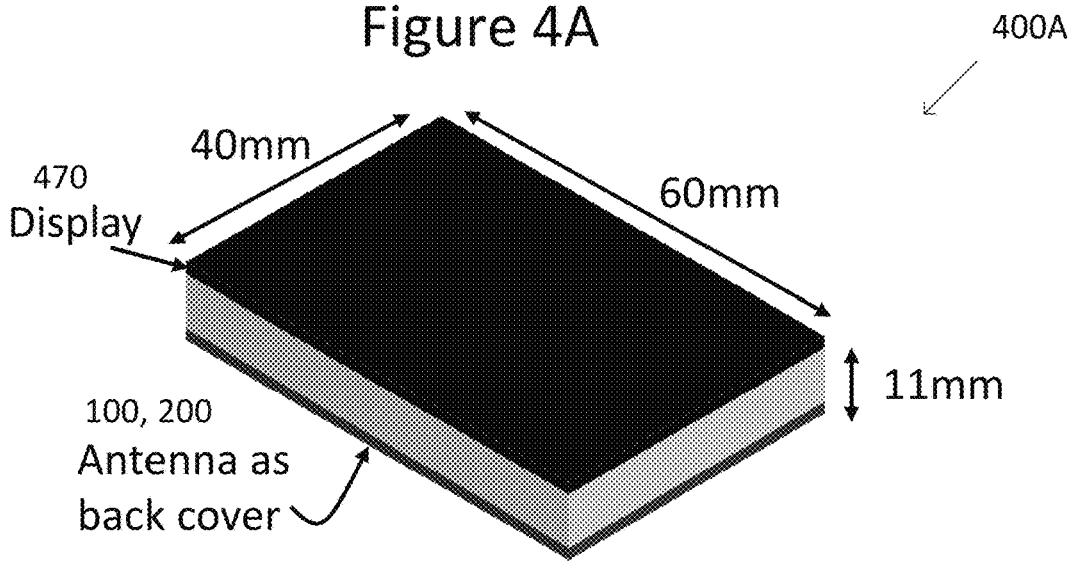
FIGS. 4A, 4B, and 4C illustrate top, bottom and side view perspective diagrams, respectively, of an antenna of any of FIG. 1A, 1B, 2A, or 2B located underneath a back cover of a wireless device.
Figure 4B:
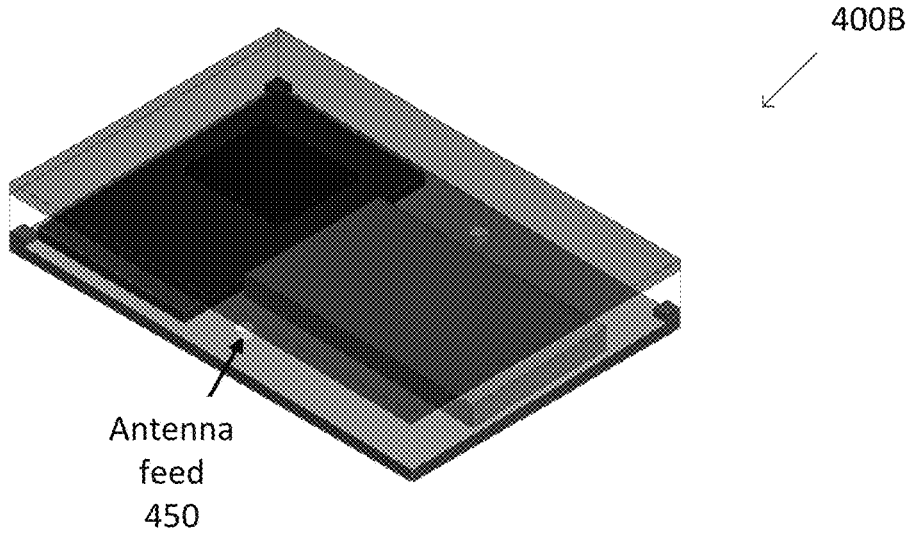
Figure 4C:
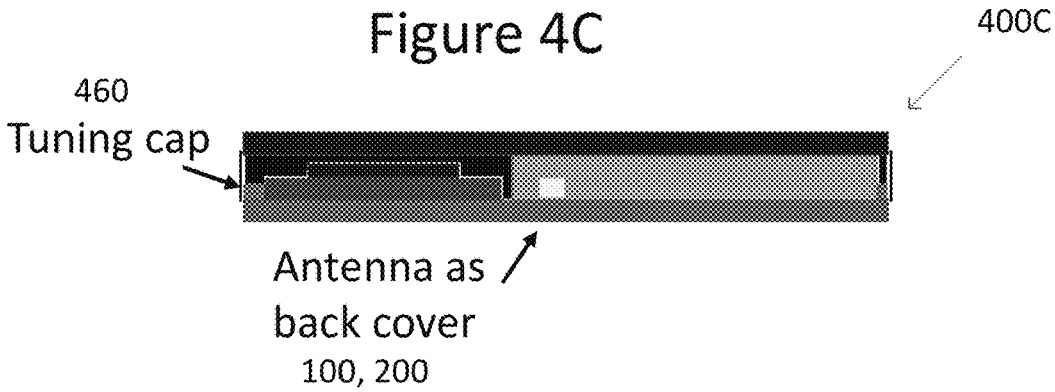

FIGS. 4A, 4B, and 4C illustrate top, bottom and side view perspective diagrams, respectively, of an antenna 100, 200 of any of FIG. 1A, 1B, 2A, or 2B located underneath a back cover of a wireless device 400.

The antenna of FIG. 1A, 1B, 2A, or 2B may simultaneously be used as a back-cover of a wireless device 400. Since the antenna 100, 200 of this disclosure has conducting layers that are grounded, other elements can be located very close to the antenna 100, 200 and have minimal effect on resonance. Thus, the antenna 100, 200 may be an integral part of the back cover of the wireless device 400 as illustrated in FIGS. 4A-C. Similar features that are described above or that are well known and shown in FIGS. 4A-C are not described here for the sake of brevity.

Figure 5A:
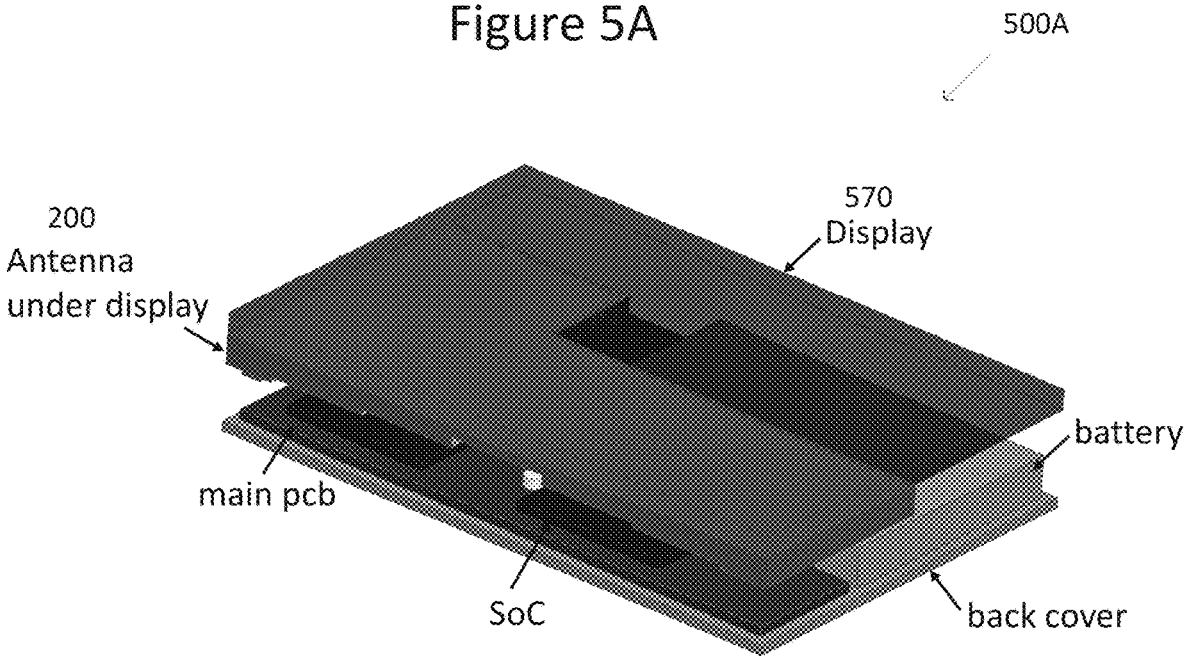
FIGS. 5A and 5B illustrate top and side view perspective diagrams, respectively, of an antenna of FIGS. 2A and 2B located underneath a display of a wireless device.
Figure 5B:
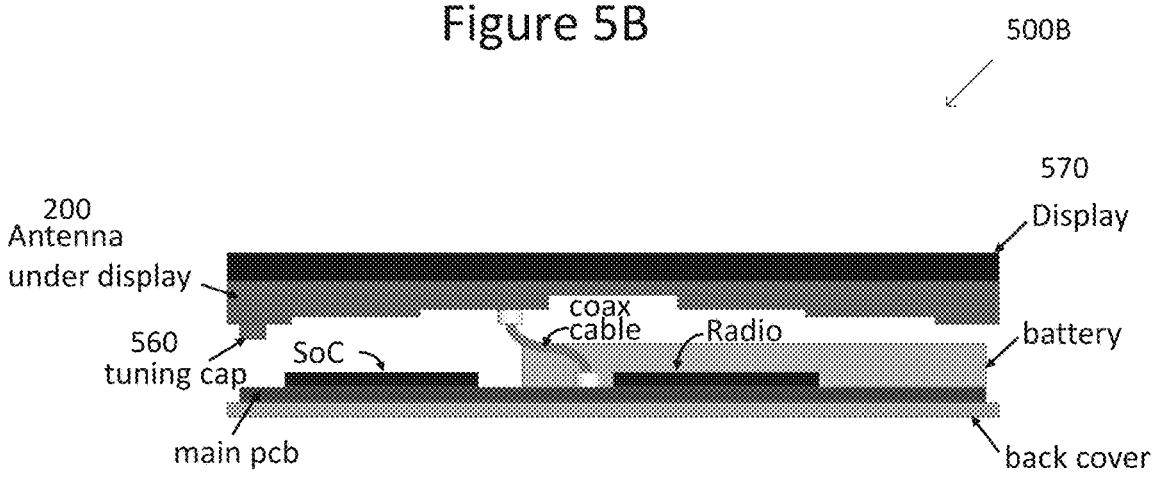

FIGS. 5A and 5B illustrate top and side view perspective diagrams, respectively, of an antenna 200 of FIGS. 2A and 2B located underneath a display of a wireless device 500.

In cases where the antenna bandwidth and efficiency needs to be improved, the thickness of the antenna cavities 240 may be tapered from a minimum thickness (away from the open faces) to a maximum thickness (at the open faces), as illustrated in FIGS. 5A and 5B. This provides a viable tradeoff between bandwidth and antenna volume. Hence, FIGS. 5A and 5B show the integration of the antenna 200 in a small form-factor wireless device 500. The tapered thickness and irregular contour of the antenna 200 permits the best use of the available space of the wireless device 500 because tall components can be located near the lower thickness areas or the areas that the antenna 200 does not occupy. If a tuning component 560 is used, this antenna 200 can be made to cover the same overall bands as that of the embodiment of FIGS. 4A-C with a single antenna feed 450. The addition of one or more solid conductive walls or via conductive walls does not negatively affect performance. Similar features that are described above or that are well known and shown in FIGS. 5A-B are not described here for the sake of brevity.

Figure 6A:
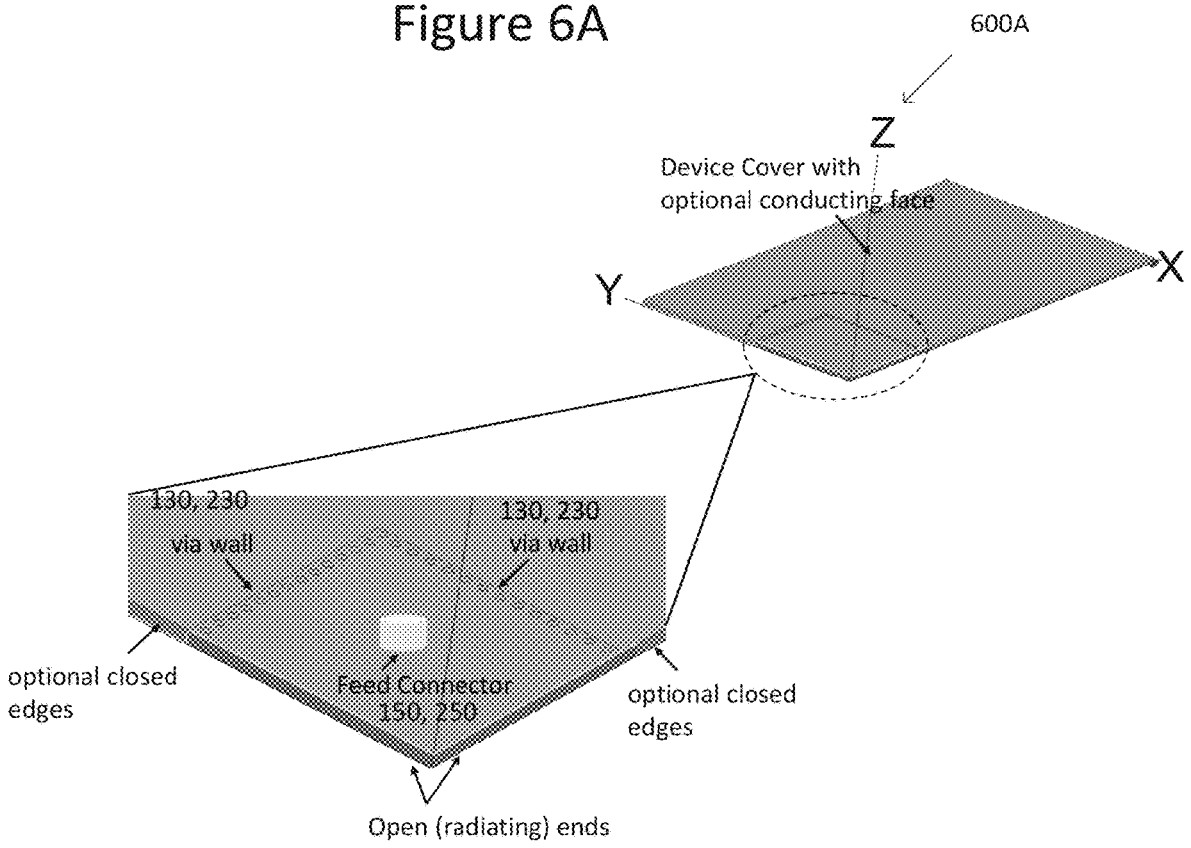
FIGS. 6A and 6B illustrate top and bottom view perspective diagrams, respectively, of an antenna of any of FIG. 1A, 1B, 2A, or 2B located underneath as an integral portion of a back cover of a wireless device.
Figure 6B:
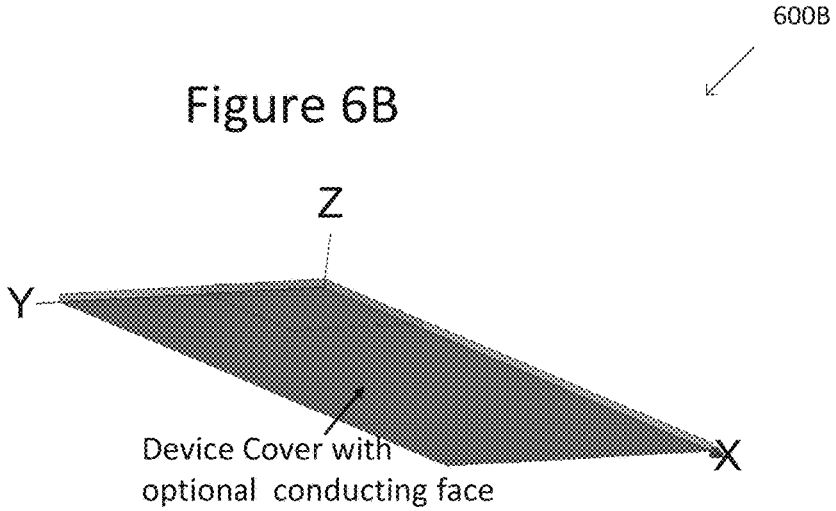

FIGS. 6A and 6B illustrate top and bottom view perspective diagrams, respectively, of an antenna of any of FIG. 1A, 1B, 2A, or 2B located underneath as an integral portion of a back cover 600 of a wireless device.

The antenna cavities 140, 240 may be integrated within the back-cover 600 of a wireless device. If the back cover 600 of the wireless device is larger in area than the antenna cavities 140, 240, then the antenna cavities 140, 240 may be fully embedded within the back cover 600.

FIGS. 6A and 6B show a single cavity embedded in a back cover 600 as an example. For frequencies above 2.4 GHz, the antenna cavity thickness may be as small as 1.5 mm. Thus, if the back cover material of a wireless device is around 1.5 mm, the antenna may be fully embedded within the back cover 600 as suggested and be completely unnoticed. For lower frequencies, a larger thickness may be required, but embedding the antenna cavity 140, 240 within the back cover 600 will reduce the effective overall thickness of the antenna 100, 200 within the wireless device. For example, if the antenna cavity 140, 240 is 2 mm thick and the back cover 600 is only 1 mm thick, embedding the antenna cavity 140, 240 would effectively reduce its thickness by 50% because only 1 mm of it would protrude beyond the back cover 600. Of course, a proper selection of the dielectric material is required to maintain radiation efficiency. For cost reduction, the dielectric substrate 110, 210 may be made from a different material than the rest of the back cover 600 using a suitable manufacturing process.

The back cover 600 may be conducting (as shown), or alternatively, not conducting. If the antenna cavity 140, cavity and the back-cover 600 are of the same thickness, the antenna would go completely unnoticed. The relatively small impact of severe device dimension changes suggests that the antenna of this disclosure enables antenna re-use across different devices without antenna redesign. Similar features that are described above or that are well known and shown in FIGS. 6A-B are not described here for the sake of brevity.

Figure 7A:
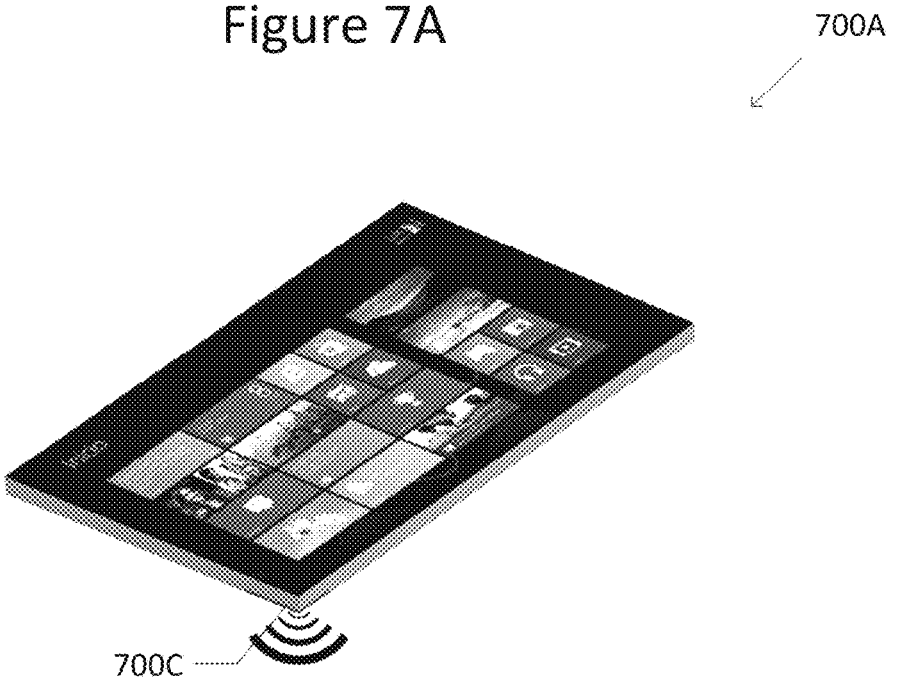
FIG. 7A illustrates a top view perspective diagram of a wireless device having an antenna of any of FIG. 1A, 1B, 2A, or 2B in an interchangeable card format.

FIG. 7A illustrates a top view perspective diagram of a wireless device 700 having an antenna 710 of any of FIG. 1A, 1B, 2A, or 2B in an interchangeable card format.

Printed Circuit Board (PCB) technology provides compactness and structural stability to envision "antenna cards" that are interchangeable similar to Secure Digital (SD) memory cards or cell phone Subscriber Identity Module (SIM) cards. Also, generic "antenna cards" may be interchangeable in different devices regardless of their shape, size, or material (e.g., fully metallic back cover or not). For example, in order to cover different world markets, the wireless device manufacturer could ship the wireless device with the corresponding antenna options, either preinstalled or installed by the user or dealer upon receipt of the shipment. Alternatively, wireless device owners may acquire a less expensive antenna card for use at a single world region if desired, or a more advanced and costly multi-region or tunable antenna card.

Figure 7B:
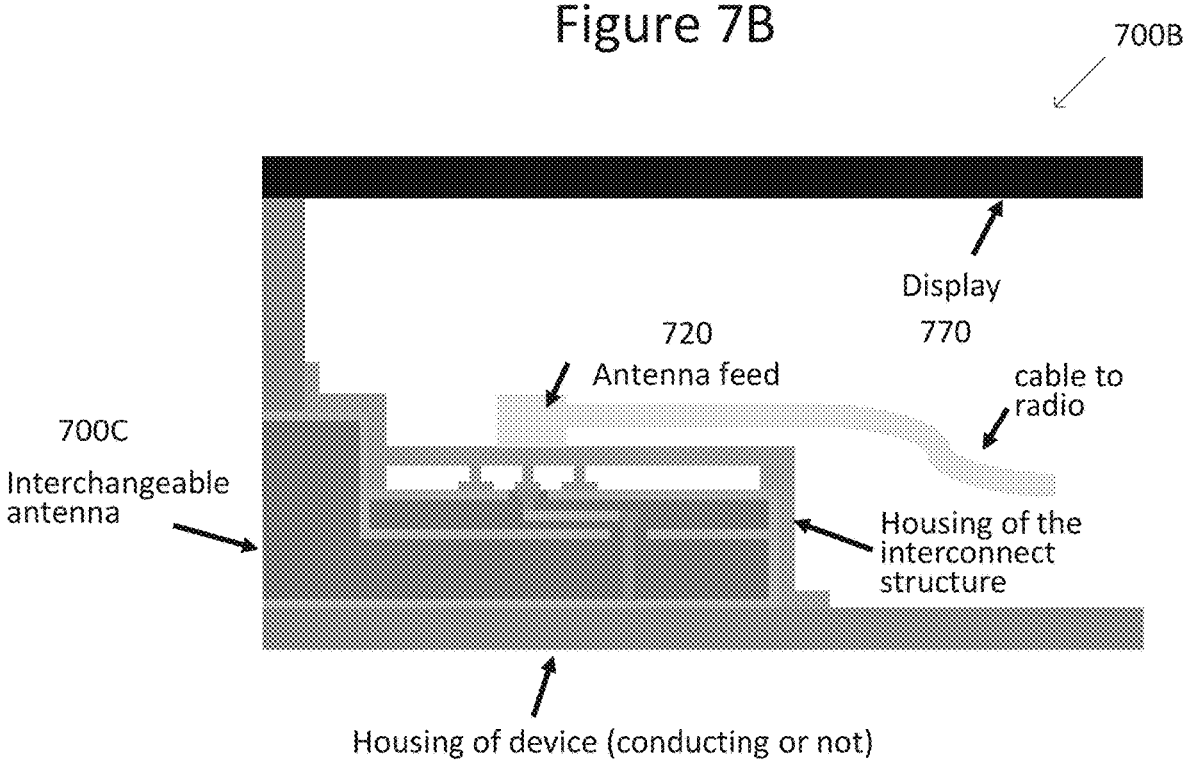
FIG. 7B illustrates a side view schematic diagram of a wireless device, antenna card, and antenna socket.
Figure 7C:
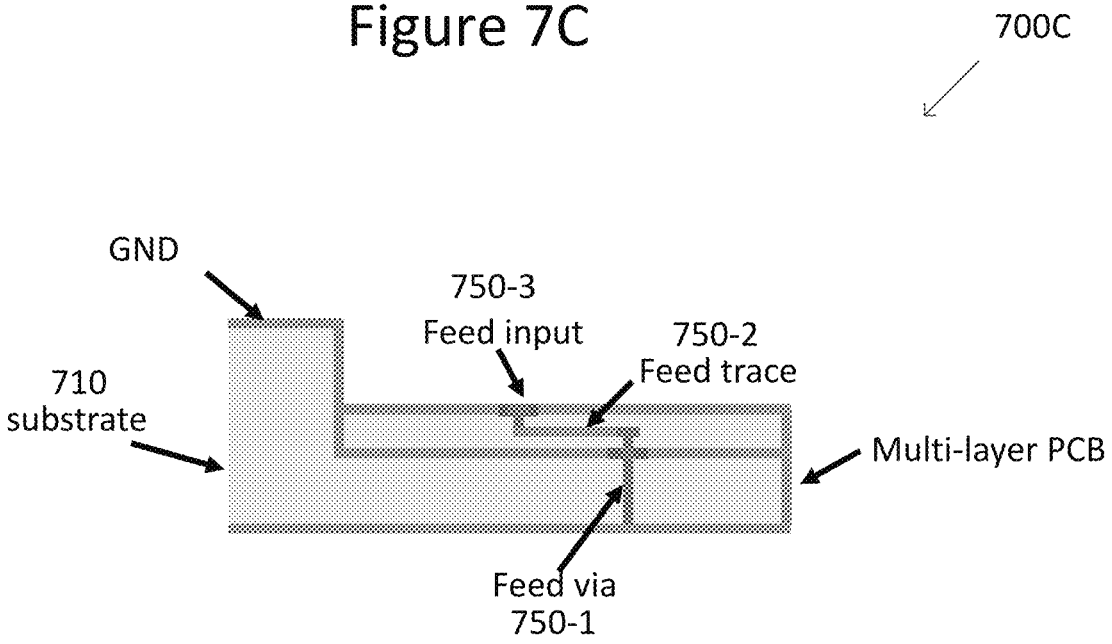
FIG. 7C illustrates a side view schematic diagram of the antenna card of FIG. 7B.
Figure 7D:
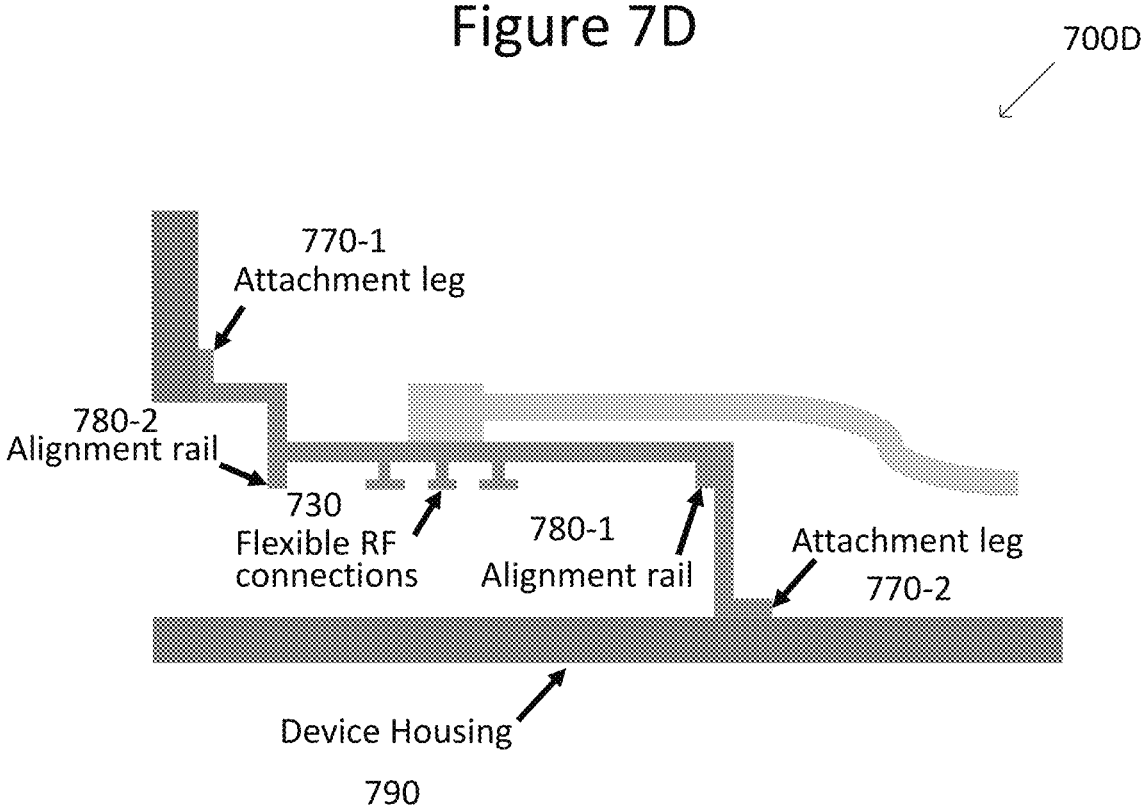
FIG. 7D illustrates a side view schematic diagram of the antenna socket of FIG. 7B.

FIG. 7A illustrates an example of a tablet-like device 700A with an interchangeable antenna card 700C. FIG. 7B illustrates a side view schematic diagram of a wireless device 700A, antenna card 700C, and antenna socket 700D. FIG. 7C illustrates a side view schematic diagram of the antenna card 700C. FIG. 7D illustrates a side view schematic diagram of the antenna socket 700D. The interchangeable antenna card 700C is slidable into the socket 700D at one corner of the wireless device 700A.

The wireless device 700A has an interconnect structure or socket 700D and a removable antenna card 700C that can be inserted in place into the socket 700D. In order to enable interchangeability, the antenna card 710C must have an interconnect layer, which comprises the feed trace 150-2 and the feed input 150-3, within the substrate 710 in order to enable different antenna feed 750 locations. The external Radio Frequency (RF) feed 720 remains at a fixed location at the antenna socket 700D while the internal feed 750 via exciting the antenna cavity can be different for different antenna cards 700C provided there is a layer for a feed trace 750-2 to take the RF signal from the feed 720 to the feed via 750-1.

The antenna socket 700D comprises alignment rails 780 to drive the antenna card 700C into place. These alignment rails 780 may or not be conductive in order to provide ground connection between the antenna card 700C and the socket 700D. Attachment legs 770 secure the socket 700D to the device housing. Also, some form of connection pins 730 (flexible or not) connect the RF signal from the socket 700D to the antenna card 700C. Additional connections may be needed for tuning control (not shown) if tuning is desired.

Similar features that are described above or that are well known and shown in FIGS. 7A-D are not described here for the sake of brevity.

The wireless device described herein may be a tablet device, smart phone, watch, laptop, or any other wireless device.

Cavity-resonator-based antennas have not previously been considered for use in small form factor devices because of their dimensions and narrowband performance. However, this disclosure enables the use of such antennas in small form factor devices with important advantages over typical antennas.

The same antenna may be used in different devices. Because the antenna is more resilient to nearby objects than typical antennas, the same antenna can be re-used for similar devices of different dimensions and materials. This would entail significant cost and time-to-market savings.

There is ultra-tight antenna packaging within the device. The antenna of this disclosure may be packaged into devices with other components (battery, connectors, speakers, etc.), even when the components touch surfaces of the antenna. This is because the antenna of this disclosure offers high resilience against the presence of objects around it, and even in contact with the metal area of the antenna of this disclosure thanks to the intrinsic radiation characteristics. The only susceptible areas are the transversal open sides, but since this area is significantly smaller, the chances of interference can be avoided easily.

The antenna of this disclosure may be used as both the antenna and the back-cover of a device simultaneously. Thus, the antenna would take virtually no space within the device.

The antenna of this disclosure may be used with devices that have fully conductive back covers, i.e., metallic unibody design.

The antenna of this disclosure may have multiple, tunable cavities for flexible multi-band operation.

The antenna is also interchangeable. Because of its compact low-profile and high environment resilience, the antenna can be made interchangeable in a similar manner to that of Secure Digital (SD) memory cards. Hence, a new "antenna card" concept is available. This provides new possibilities in device distribution and cost targeting for diverse markets and usage.

Example 1 is an antenna, comprising: a substrate; top and bottom grounded conductive layers formed on respective larger faces of the substrate; at least one conductive wall formed to the top and bottom grounded conductive layers, and configured to form a short-circuit between the top and bottom grounded conductive layers, wherein the substrate and the at least one conductive wall forms a plurality of antenna cavities configured to operate at specific, respective frequencies, and each of the plurality of antenna cavities comprises at least two edges not covered by a conductive layer; and an antenna feed coupled to at least one of the top and bottom grounded conductive layers of each of the antenna cavities, and configured to feed radio signals to the respective antenna cavity.

In Example 2, the subject matter of Example 1, wherein the substrate has a constant thickness.

In Example 3, the subject matter of Example 1, wherein the substrate has an irregular material comprised of any of air, dielectric, magnetic, and a combination thereof.

In Example 4, the subject matter of Example 1, wherein the substrate has a regular contour.

In Example 5, the subject matter of Example 1, wherein the substrate has an irregular contour.

In Example 6, the subject matter of Example 1, wherein the at least one conductive wall is a solid wall.

In Example 7, the subject matter of Example 1, wherein the at least one conductive wall comprises vias.

In Example 8, the subject matter of Example 1, further comprising: a tuning component coupled to at least one of the top and bottom grounded conductive layers of at least one of the antenna cavities, and configured to tune the antenna cavity to a specific frequency.

In Example 9, the subject matter of Example 1, wherein the antenna is an interchangeable antenna card with an interconnect layer and is insertable in a wireless device.

Example 10, is a wireless device, comprising the subject matter of Example 1.

In Example 11, the subject matter of Example 10, wherein the antenna forms at least a portion of a back cover of the wireless device.

In Example 12, the subject matter of Example 10, further comprising: a socket configured to receive the antenna.

Example 13 is an antenna, comprising: a substrate having at least one of an irregular contour and an irregular thickness; top and bottom grounded conductive layers formed on respective larger faces of the substrate; an antenna feed coupled to at least one of the top and bottom grounded conductive layers, and configured to feed radio signals to the antenna, wherein the substrate forms an antenna cavity configured to operate at a specific frequency, and comprises at least two sides not covered by a conductive layer.

In Example 14, the subject matter of Example 13, wherein the substrate has a constant thickness.

In Example 15, the subject matter of Example 13, wherein the substrate has an irregular thickness.

In Example 16, the subject matter of Example 13, wherein the substrate has a regular contour.

In Example 17, the subject matter of Example 13, wherein the substrate has an irregular contour.

In Example 18, the subject matter of Example 13, further comprising: a tuning component coupled to at least one of the top and bottom grounded conductive layers, and configured to tune the antenna to a specific frequency.

In Example 19, the subject matter of Example 13, wherein the antenna is an interchangeable antenna card with an interconnect layer and is insertable in a wireless device.

Example 20 is a wireless device, comprising: the subject matter of Example 13.

In Example 21, the subject matter of Example 20, wherein the antenna forms at least a portion of a back cover of the wireless device.

In Example 22, the subject matter of Example 20, further comprising: a socket configured to receive the antenna.

Example 23 is a method of forming an antenna, the method comprising: forming a substrate having at least one of an irregular contour and an irregular thickness; forming top and bottom grounded conductive layers on respective larger faces of the substrate; forming an antenna feed coupled to at least one of the top and bottom grounded conductive layers, and configured to feed radio signals to the antenna, wherein the substrate forms an antenna cavity configured to operate at a specific frequency, and comprises at least two sides not covered by a conductive layer.

In Example 24, the subject matter of Example 23, further comprising: forming at least one conductive wall to the top and bottom grounded conductive layers, to form a short-circuit between the top and bottom grounded conductive layers, wherein the substrate and the at least one conductive wall form a plurality of antenna cavities configured to operate at specific, respective frequencies, and each of the antenna cavities comprises at least two sides not covered by a conductive layer.

In Example 25, the subject matter of Example 24, wherein the forming the at least one conductive wall comprises forming vias.

Example 26 is a wireless device, comprising: the subject matter of any of Examples 1-9.

Example 27 is a wireless device, comprising: the subject matter of any of Examples 13-19.

Example 28 is an apparatus substantially as shown and described.

Example 29 is a method substantially as shown and described.

While the foregoing has been described in conjunction with exemplary aspect, it is understood that the term "exemplary" is merely meant as an example, rather than the best or optimal. Accordingly, the disclosure is intended to cover alternatives, modifications and equivalents, which may be included within the scope of the disclosure.

Although specific aspects have been illustrated and described herein, it will be appreciated by those of ordinary skill in the art that a variety of alternate and/or equivalent implementations may be substituted for the specific aspects shown and described without departing from the scope of the present application. This application is intended to cover any adaptations or variations of the specific aspects discussed herein.

The invention claimed is:

1. An antenna, comprising:

a substrate;

top and bottom grounded conductive layers formed on respective larger faces of the substrate;

at least one conductive wall formed to the top and bottom grounded conductive layers, and configured to form a short-circuit between the top and bottom grounded conductive layers, wherein the substrate and the at least one conductive wall forms a plurality of antenna cavities configured to operate at specific, respective frequencies, and each of the plurality of antenna cavities comprises at least two edges not covered by a conductive layer; and an antenna feed coupled to at least one of the top and bottom grounded conductive layers of each of the antenna cavities, and configured to feed radio signals to the respective antenna cavity.

2. The antenna of claim 1, wherein the substrate has a constant thickness.

3. The antenna of claim 1, wherein the substrate has an irregular material comprised of any of air, dielectric, magnetic, and a combination thereof.

4. The antenna of claim 1, wherein the substrate has a regular contour.

5. The antenna of claim 1, wherein the substrate has an irregular contour.

6. The antenna of claim 1, wherein the at least one conductive wall is a solid wall.

7. The antenna of claim 1, wherein the at least one conductive wall comprises vias.

8. The antenna of claim 1, further comprising:

a tuning component coupled to at least one of the top and bottom grounded conductive layers of at least one of the antenna cavities, and configured to tune the antenna cavity to a specific frequency.

9. The antenna of claim 1, wherein the antenna is an interchangeable antenna card with an interconnect layer and is insertable in a wireless device.

10. A wireless device, comprising:

the antenna of claim 1.

11. The wireless device of claim 10, wherein the antenna forms at least a portion of a back cover of the wireless device.

12. The wireless device of claim 10, further comprising:

a socket configured to receive the antenna.

13. An antenna, comprising:

a substrate having at least one of an irregular contour and an irregular thickness;

top and bottom grounded conductive layers formed on respective larger faces of the substrate; and an antenna feed coupled to at least one of the top and bottom grounded conductive layers, and configured to feed radio signals to the antenna, wherein the substrate forms an antenna cavity configured to operate at a specific frequency, and comprises at least two sides not covered by a conductive layer.

14. The antenna of claim 13, wherein the substrate has a constant thickness.

15. The antenna of claim 13, wherein the substrate has an irregular thickness.

16. The antenna of claim 13, wherein the substrate has a regular contour.

17. The antenna of claim 13, wherein the substrate has an irregular contour.

18. The antenna of claim 13, further comprising:

a tuning component coupled to at least one of the top and bottom grounded conductive layers, and configured to tune the antenna to a specific frequency.

19. The antenna of claim 13, wherein the antenna is an interchangeable antenna card with an interconnect layer and is insertable in a wireless device.

20. A wireless device, comprising:

the antenna of claim 13.

21. The wireless device of claim 20, wherein the antenna forms at least a portion of a back cover of the wireless device.

22. The wireless device of claim 20, further comprising:

a socket configured to receive the antenna.

23. A method of forming an antenna, the method comprising:

forming a substrate having at least one of an irregular contour and an irregular thickness;

forming top and bottom grounded conductive layers on respective larger faces of the substrate; and forming an antenna feed coupled to at least one of the top and bottom grounded conductive layers, and configured to feed radio signals to the antenna, wherein the substrate forms an antenna cavity configured to operate at a specific frequency, and comprises at least two sides not covered by a conductive layer.

24. The method of claim 23, further comprising:

forming at least one conductive wall to the top and bottom grounded conductive layers, to form a short-circuit between the top and bottom grounded conductive layers, wherein the substrate and the at least one conductive wall form a plurality of antenna cavities configured to operate at specific, respective frequencies, and each of the antenna cavities comprises at least two sides not covered by a conductive layer.

25. The method of claim 24, wherein the forming the at least one conductive wall comprises forming vias.

* * * * *